US005616918A

United States Patent [19]

Oishi et al.

[11] Patent Number: 5,616,918

[45] Date of Patent: Apr. 1, 1997

[54] PLASMA ION MASS SPECTROMETER AND PLASMA MASS SPECTROMETRY USING THE SAME

[75] Inventors: Konosuke Oishi, Mito; Toyoharu Okumoto, Hitachinaka; Masamichi Tsukada, Higashi; Takashi Iino, Hitachinaka, all of Japan

[73] Assignee: Hitachi, Ltd., Tokyo, Japan

[21] Appl. No.: 539,258

[22] Filed: Oct. 5, 1995

[30] Foreign Application Priority Data

Oct. 11, 1994 [JP] Japan ..... 6-245039

[51] Int. Cl.[6] ..... H01J 49/06

[52] U.S. Cl. ..... 250/288; 250/281; 250/282

[58] Field of Search ..... 250/288, 288 A, 250/281, 282, 290, 291, 292

[56] References Cited

U.S. PATENT DOCUMENTS

| | | | |
|---|---|---|---|
| 4,540,884 | 9/1985 | Stafford et al. | 250/282 |
| 4,955,717 | 9/1990 | Henderson | 250/288 |
| 5,179,278 | 1/1993 | Douglas | 250/292 |
| 5,481,107 | 1/1996 | Takada et al. | 250/288 |

OTHER PUBLICATIONS

Spectrochimica ACTA., vol. 49B, No. 9, pp. 901–914 Konosuke Oishi et al.: *Elemental Mass Spectrometry Using a Nitrogen Microwave-induced Plasma as an Ion Source*, May 1994.

*Primary Examiner*—Jack I. Berman
*Assistant Examiner*—Kiet T. Nguyen
*Attorney, Agent, or Firm*—Kenyon & Kenyon

[57] ABSTRACT

A plasma ion mass spectrometer capable of improving detection accuracy in mass spectrometry by reducing background noise due to ultraviolet radiation and neutral particles, and a plasma ion mass spectrometry using the same. A sample is ionized with plasma in a plasma generating portion. The flow of the ionized sample is shielded by a shield plate after an elapse of a specified time, and ions of the sample accumulated before the shielding is held in an ion trap type mass spectrometric portion for a specified time. The ions of the sample held for the specified time are then subjected to mass spectrometry. During ions of the sample accumulated before the shielding are held, ultraviolet radiation mixed with the ions of the sample disappears, and thereby only ions of the sample can be subjected to mass spectrometry. As a result, background noise is reduced, to improve detection accuracy in mass spectrometry.

16 Claims, 6 Drawing Sheets

$T_1 \sim T_2$ $T_2 \sim T_3$ $T_3 \sim T_4$

PLASMA ION MASS SPECTROMETER AND PLASMA MASS SPECTROMETRY USING THE SAME

BACKGROUND OF THE INVENTION

1. Field of the Invention

The present invention relates to a plasma ion mass spectrometer and a plasma mass spectrometry using the same.

2. Description of the Related Art

A plasma ion mass spectrometer has a function to ionize a sample in plasma at a high temperature, and to perform mass spectrometry for the ionized sample. Such a plasma ion mass spectrometer has been disclosed, for example in Japanese Patent Laid-open No. Sho 60-133648.

A plasma ion mass spectrometer is suitable for analysis of trace amounts of elements contained in a sample, particularly, for analysis of trace amounts of poisonous elements (such as chromium, lead and mercury) contained in water of rivers and marshes, or lakes and marshes. It is also effective for analysis of trace amounts of impurities (such as boron, phosphorous and aluminum) contained in ultra-pure water used for cleaning a wafer in a process of fabricating a semiconductor electronic device such as a memory chip for a computer.

The above-described plasma ion mass spectrometer, however, is disadvantageous in that ultraviolet radiation having a high intensity is generated by plasma and it gives background noise to an ion detector, deteriorating detection accuracy.

SUMMARY OF THE INVENTION

An object of the present invention is to provide a plasma ion mass spectrometer capable of improving detection accuracy in mass spectrometry by reducing background noise due to ultraviolet radiation, and to provide a plasma ion mass spectrometry using the same.

To achieve the above object, according to a preferred mode of the present invention, there is provided a plasma ion mass spectrometry, comprising the steps of:

ionizing a sample with plasma;

shielding the flow of the ionized sample after an elapse of a specified time;

holding, for a specified time, ions of the sample accumulated before shielding the flow of the ionized sample; and performing mass spectrometry for ions of the sample held for the specified time.

In the above-described plasma ion mass spectrometer of the present invention, when the flow of the ionized sample is shielded by the shielding means, ultraviolet radiation is also cut off; and further, during ions of the sample accumulated before shielding are held, the ultraviolet radiation mixed with the ions of the sample disappears. As a result, only the ions of the sample can be held.

Since ultraviolet radiation is thus excluded and only ions of a sample is subjected to mass spectrometry, it is possible to reduce background noise, and hence to improve detection accuracy in mass spectrometry.

BRIEF DESCRIPTION OF THE DRAWINGS

The above and other objects, features and advantages of the present invention will be apparent from the following detailed description of the preferred embodiments of the present invention in conjunction with the accompanying drawings, in which.

DETAILED DESCRIPTION OF THE PREFERRED EMBODIMENTS

Preferred embodiments of the present invention will be described with reference to the accompanying drawings.

Figure 1:
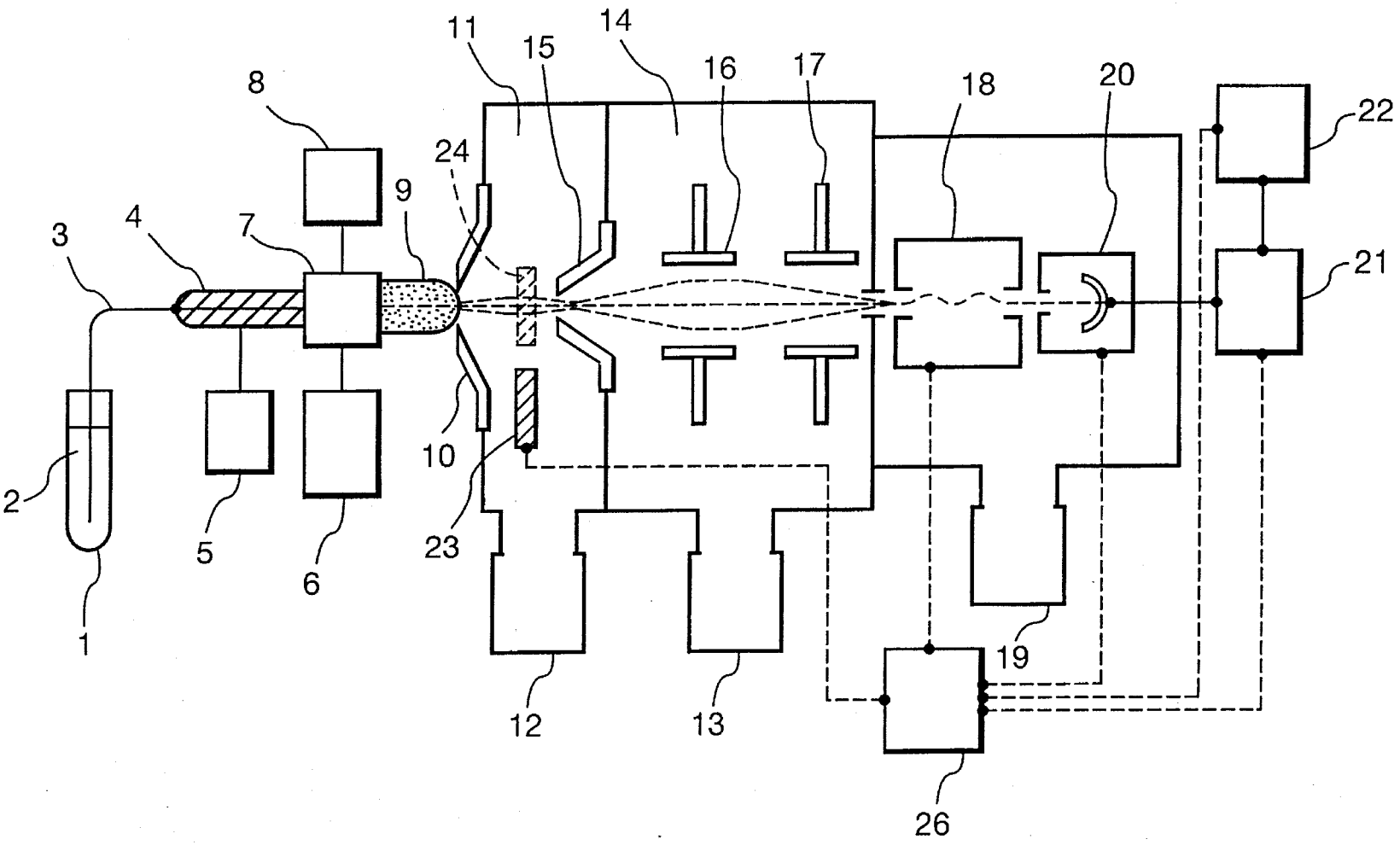
FIG. 1 is a view of the entire configuration of a first embodiment of the present invention.

Referring to FIG. 1, a solution sample 2 in a vessel 1 is sucked to a plasma separating portion 7 by a nebulizer 4 through a capillary 3. In this case, an inert gas (argon, nitrogen, helium or the like) is supplied from a gas flow rate adjuster 5 to the nebulizer 4 at a specified flow rate (e.g. 1.2 l/min for nitrogen) for operating the nebulizer 4. On the other hand, a high frequency electric power (e.g. 2450 MHz, 1.0 kW) is supplied from a high frequency power source 6 to the plasma generating portion 7. An inert gas for generating plasma is also supplied from a gas flow rate adjuster 8 to the plasma generating portion 7 at a specified flow rate (e.g. 13 l/min for nitrogen). In the case of using MIP (Microwave Induced Plasma), the plasma generating portion 7 may be constructed as described in a paper [Oishi, Okamoto, Koga, Yamamoto, "Microwave Plasma Trace Element Analyzer", Hitachi Review, 73, No. 9, 61–66 (1991)].

A plasma 9 at a high temperature of about 6,000 K is thus generated by the plasma generating portion 7. The nebulized sample 2 is then introduced in the plasma 9, to be dissociated into ions and electrons.

The above ions and electrons of the sample 2 are sucked from a pure copper made sampling cone 10 having at the center a fine hole (diameter: 0.8 mm, depth: 0.5 mm) into a sample introducing portion (first vacuum chamber) 11. The sample introducing portion 11, which is previously evacuated in a vacuum of $10^{-2}$ Pa by a vacuum pump 12, is connected to a second vacuum chamber 14 through a skimmer cone 15. The second vacuum chamber 14 is also previously evacuated in a vacuum of $10^{-4}$ Pa by means of a vacuum pump 13. The skimmer cone 15 has a fine hole (diameter: 0.4 mm, depth: 0.3 mm). Ion beams enter the second vacuum chamber 14 through the fine hole of the skimmer cone 15. The ion beams converge through electrostatic lenses 16, 17 disposed in the second vacuum chamber 14, and then enter a mass separating portion 18.

The mass separating portion 18 is previously evacuated in a vacuum of $10^{-5}$ Pa by means of a vacuum pump 19. A mass separating filter, called an ITMF (Ion Trap Mass Filter), is contained in the mass separating portion 18. The mass ion trap mass filter is capable of accumulating all of the incoming ions for a specified time, e.g. 200 ms, thereby retarding a time required for supplying the ions of the sample 2 from the plasma generating portion 7 to the ion detector 20.

Of the ions held for a specified time in the mass separating portion 18, those having a specified mass number (m/z) enter an ion detecting portion 20 so as to be analyzed. At the ion detecting portion 20, the incoming ions are converted into electric pulse signals before being fed to an amplifier 21. The amplifier 21 is connected to a signal processing/displaying portion 22 for counting the inputted electric pulse signals and displaying the counted values. The ion trap mass filter may be so constructed as described in a paper [R. Graham Cooks, G. L. Glish, S. A. Mcluckey, R. E. Kaiser, "Ion Trap Mass Spectrometry", C & E, 26, 26–41 (1991)].

The operation of mass spectrometry will be described below. A shield plate 23 is movable relative to the center axis of ion beams. Referring to FIG. 1, the shield (or restricting) plate 23, which is in the state after being moved out of the center axis of ion beams, is indicated by the solid line, whereas the position 24 of the shield plate before being moved, that is, the position 24 for shielding light is indicated by the broken line.

Figure 2A:
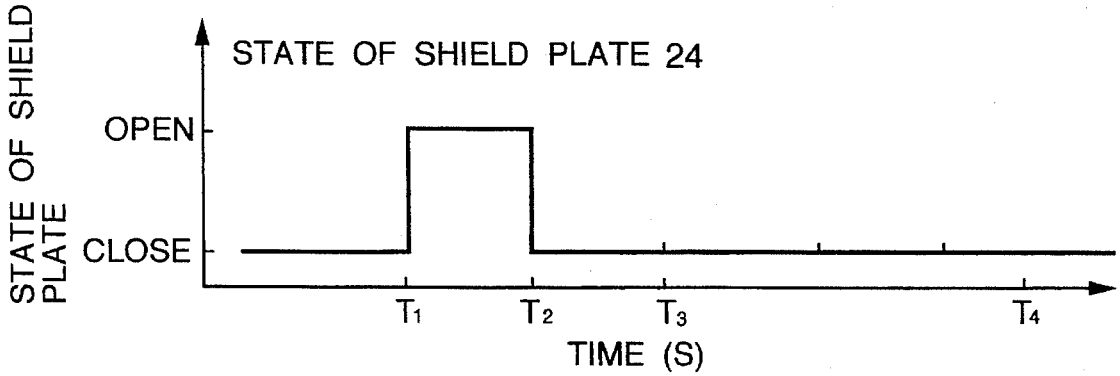
FIGS. 2A to 2C are time charts of the first embodiment.
Figure 2B:
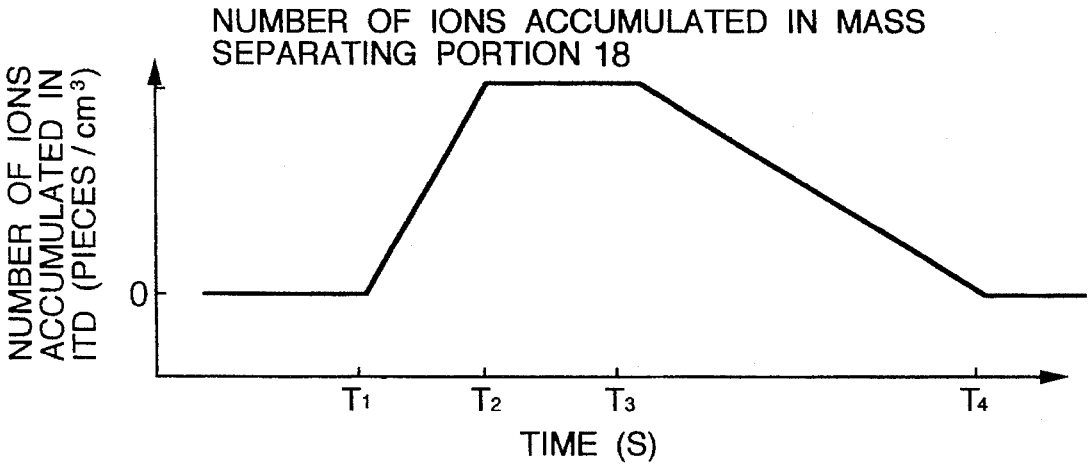
Figure 3A:
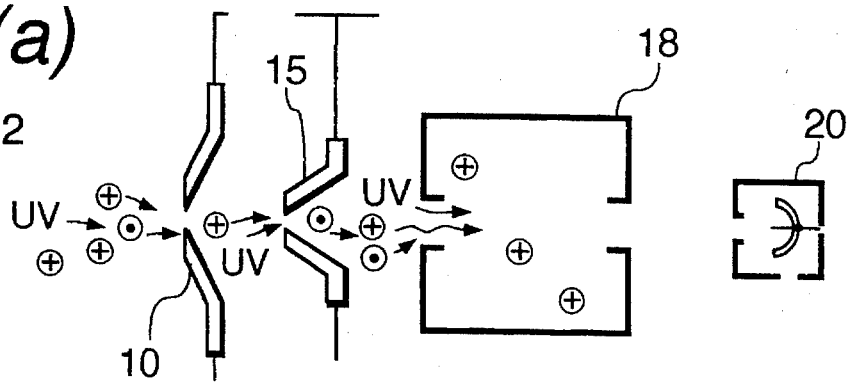
FIGS. 3A to 3C are schematic views showing the concept of the first embodiment.

Referring to FIG. 2A, at a time $T_1$, the shield plate 23 is shifted from the closed state to the open state on the basis of a signal supplied from a process controller 26. Thus, ions of the sample generated at the plasma generating portion 7 reach the mass separating portion 18 through the ions lenses 16, 17. This is schematically illustrated in FIG. 3A. As described above, the mass separating portion 18 contains the ion trap mass filter capable of accumulating ions of the sample for a specified time, e.g. about 200 msec. The shield plate 23 is kept closed, or alternatively the mass separating portion 18 is configured to shield the flow of sample 2 from the plasma generating portion 7, during a period of time from $T_1$ to $T_2$. In such a closed state of the shield plate 23, the number of ions accumulated in the mass separating portion 18 is gradually increased as shown in FIG. 2B. In this way, the mass separating portion 18 accumulates ions of the sample in an amount corresponding to the period of time ($T_2$–$T_1$). In addition, the period of time ($T_2$–$T_1$) is selected at, e.g. 100 msec.

At the time $T_2$, as shown in FIG. 2A, the shield plate 23 is shifted from the open state to the closed state on the basis of a signal supplied from the process controller 26. Thus, the shield plate 23 shields the flow of the ionized sample from the plasma generating portion 7 to the mass separating portion 18, and at the same time, it also cuts off the flow of ultraviolet radiation and neutral particles (and further electromagnetic radiation) from the plasma ion generating portion 7 to the mass separating portion 18.

Figure 3B:
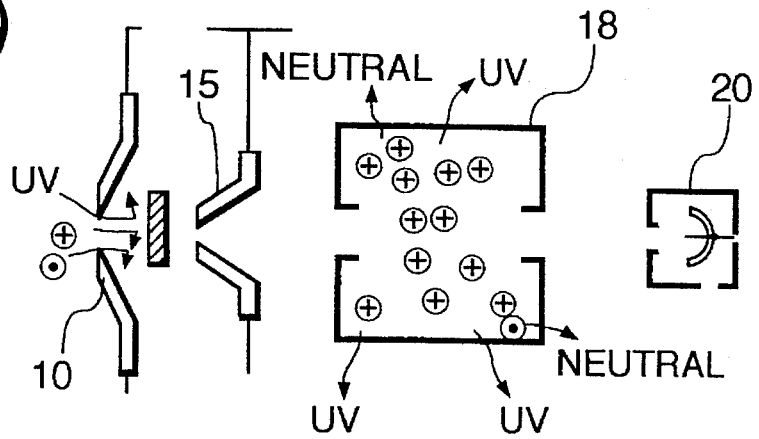

The mass separating portion holds ions of the sample during a period of time ($T_3$–$T_2$), thereby retarding a time required for supplying the ions of the sample 2 from the plasma generating portion 7 to the ion detector 20. This is schematically illustrated in FIG. 3B. Incidentally, in the mass separating portion 18, ions are held; however, ultraviolet radiation and neutral particles (and further electromagnetic radiation) are not held, and thus disappears during the period of time ($T_3$–$T_2$). The time ($T_3$–$T_2$) is set at, e.g 100 msec.

Specifically, ultraviolet radiation after having entered the mass separating portion 18 repeatedly collides with (or are reflected by) the inner wall surfaces thereof, being attenuated, and then disappears. Letting 30 nm be a distance between the wall surfaces of the mass separating portion 18, and also 100 times be the reflecting number until ultraviolet radiation disappears, the time required for the disappearance of ultraviolet radiation becomes $10^{-8}$s which is very smaller than a time ($10^{-2}$s) required for holding ions in the mass separating portion 18. On the other hand, ions held in the mass separating portion tend to be neutralized due to collision with each other, and thereby the number of the ions is decreased with time. A relatively short time is thus required to be selected for suppressing a decrease in the number of ions. For this reason, it is desirable to select the time ($T_3$–$T_2$) at 100 msec.

Consequently, ultraviolet radiation and neutral particles (and further electromagnetic radiation) are practically excluded from the mass separating portion 18 during the period of time from $T_2$ to $T_3$.

Figure 2C:
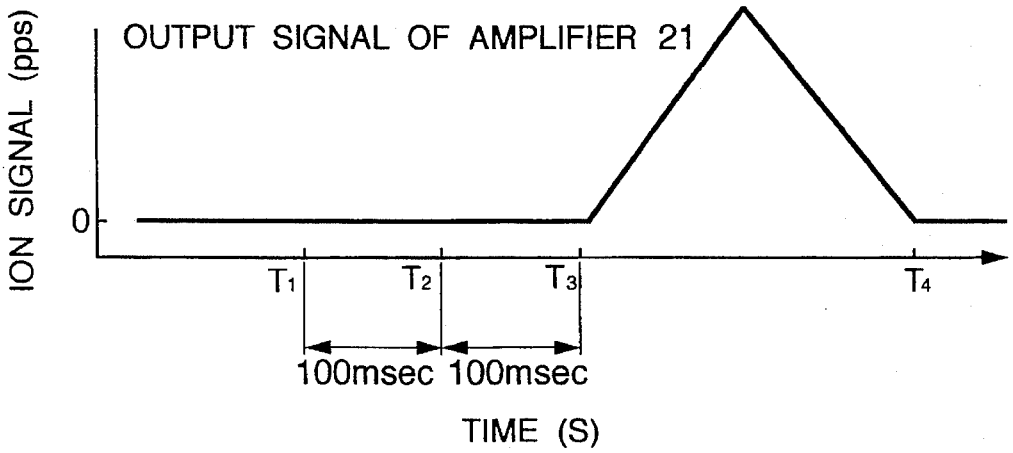
Figure 3C:
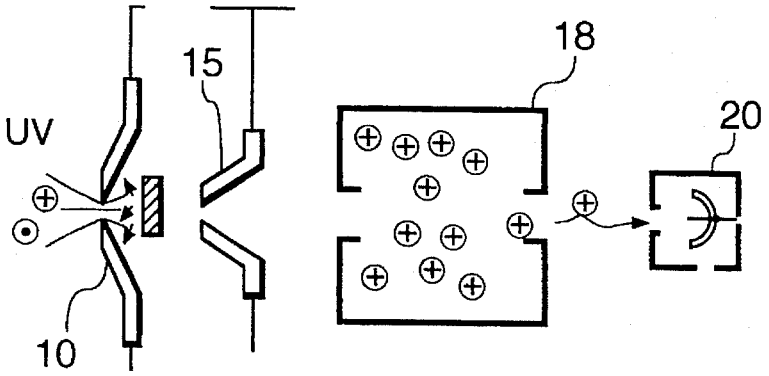

Next, at the time $T_3$, by changing the state of the mass separating portion 18, ions having the specified mass number (m/z) are emitted. This is schematically illustrated in FIG. 3C. The operation is completed at a time $T_4$. Thus, as shown in FIG. 2C, an ion signal is generated. The time ($T_3$–$T_4$) is selected at about one second. Since ultraviolet radiation and neutral particles are practically excluded at the time $T_3$, only ions are detected by the ion detector 20, thus suppressing background noise due to ultraviolet radiation and neutral particles.

The mass separating portion 18 may be so constructed that only ions of the target element such as Zn reach the ion detector 20, or ions may sequentially reach to the ion detector 20 in the order from a small mass number (m/z) to a large mass number (m/z) (for example, 10, 11, 12→99, 100).

Figure 4:
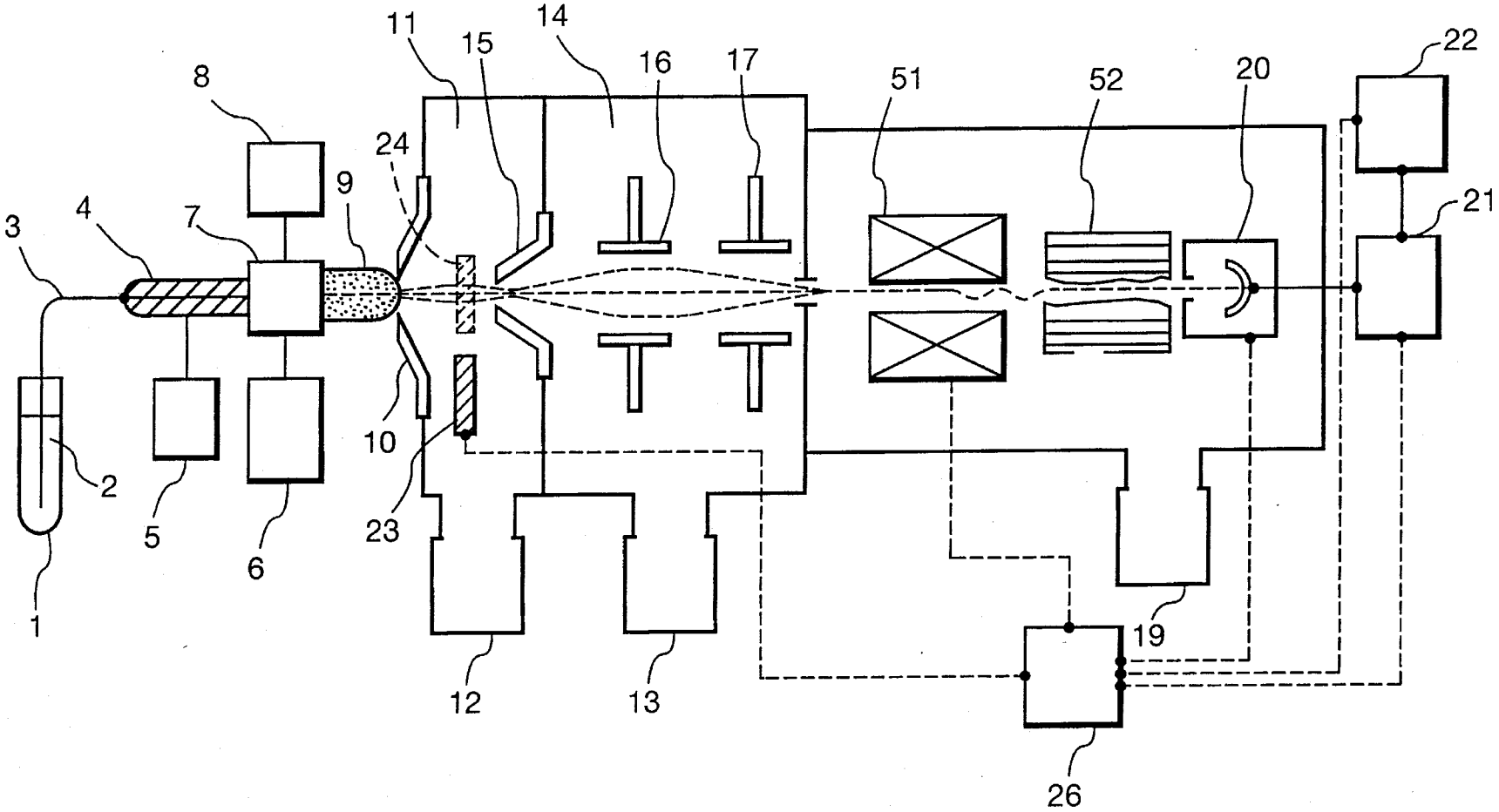
FIG. 4 is a view showing the entire configuration of a second embodiment of the present invention.
Figure 5:
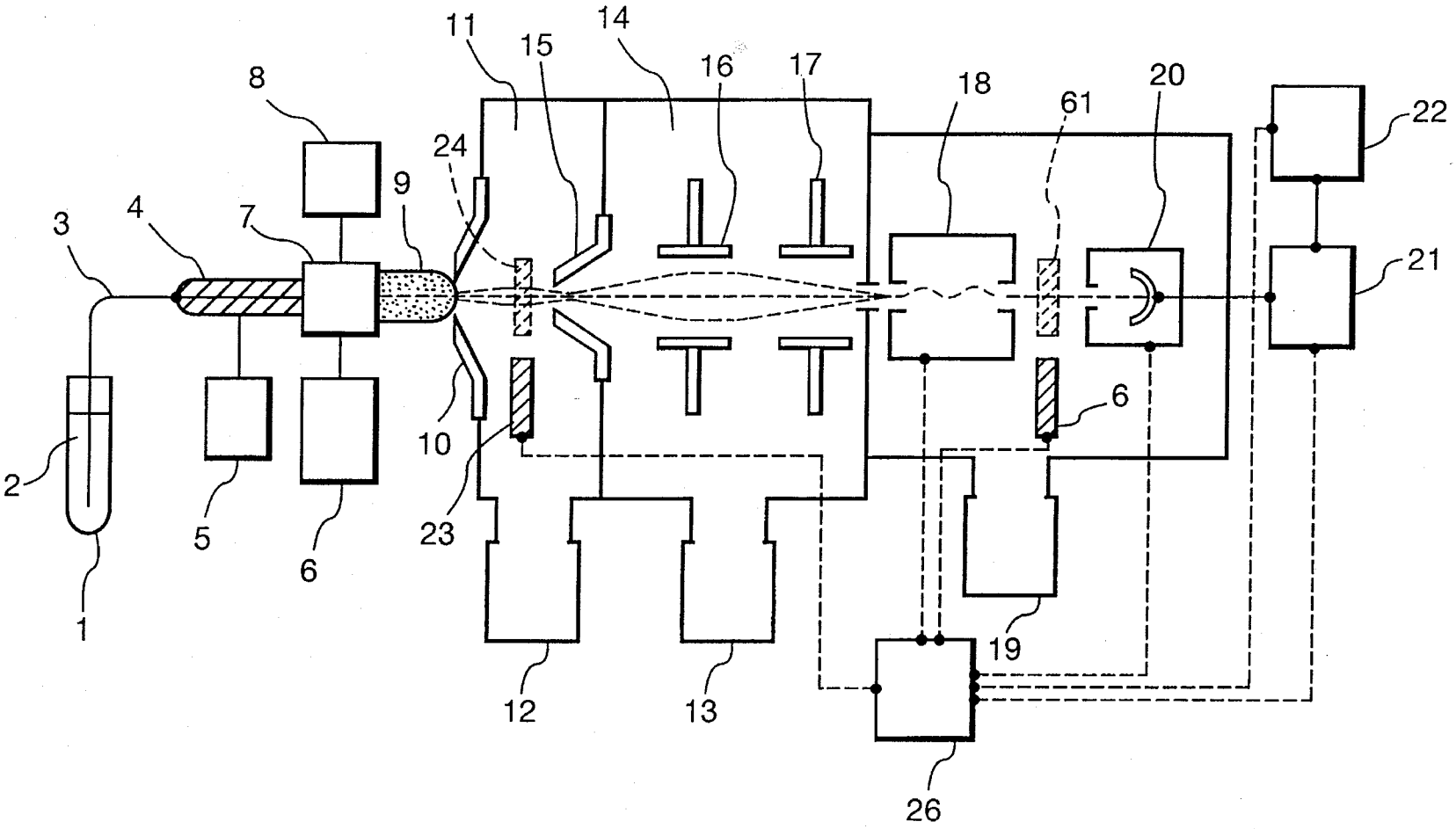
FIG. 5 is a view showing the entire configuration of a third embodiment of the present invention.

A second embodiment of the present invention will be described with reference to FIG. 4. In this embodiment, only parts different from those in the first embodiment will be described.

In the second embodiment, ions converged through electrostatic lenses 16, 17 are introduced to an ion holder 51. The ion holder 51 is capable of holding ions for a specified time, e.g. 202 msec, which is realized in the form of a cyclotron. Alternatively, as in the first embodiment, the ion trap may be used as the ion holder 51.

Specifically, the flow of ions generated in the plasma generating portion 7 are shielded by the shield plate 23, and the ions of the sample accumulated before the shielding are held in the ion holder 51 for a specified time of about 200 msec. The ions of the sample held by the ion holder 51 are then gradually supplied to a mass filter 52. The mass filter 52 used in this embodiment is of a quadruple type or a magnetic filed scanning type. In this way, of the ions in the ion holder 51, those having a specified mass number (m/z) are selected by the mass filter 52 and then detected by the ion detector. In this embodiment, the other mass filter than the ion trap mass filter may be used.

Figure 6A:
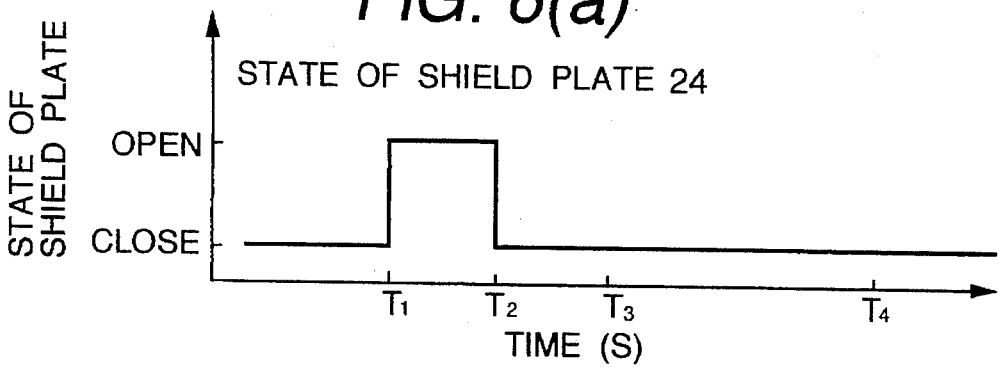
FIGS. 6A to 6D are time charts of the third embodiment.
Figure 6B:
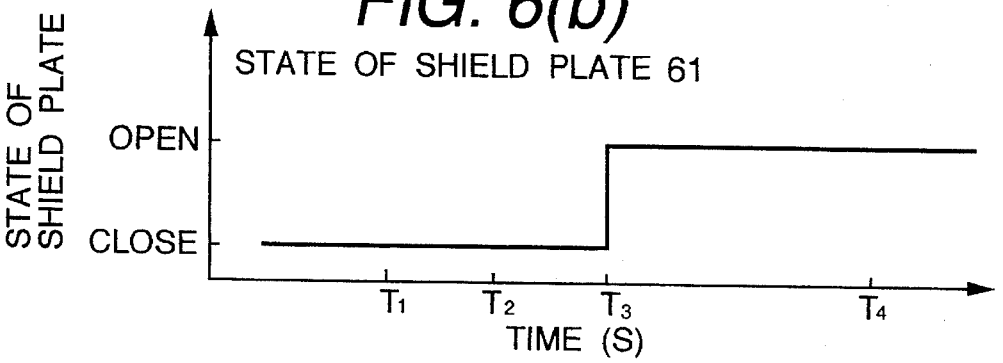
Figure 6C:
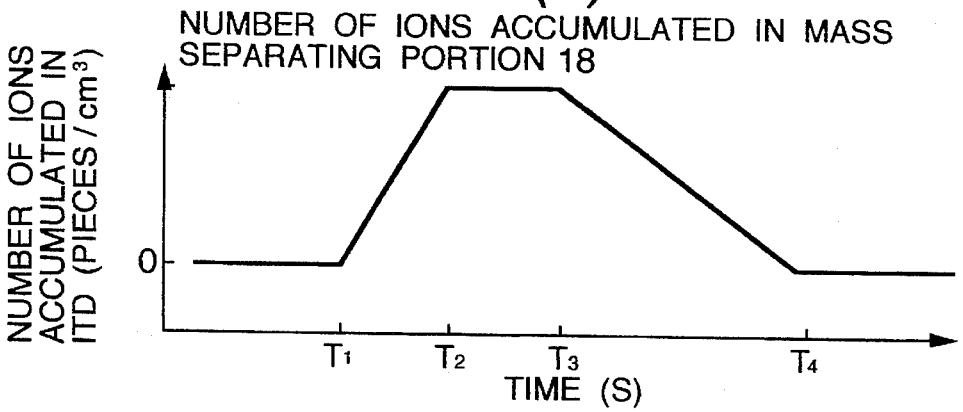
Figure 6D:
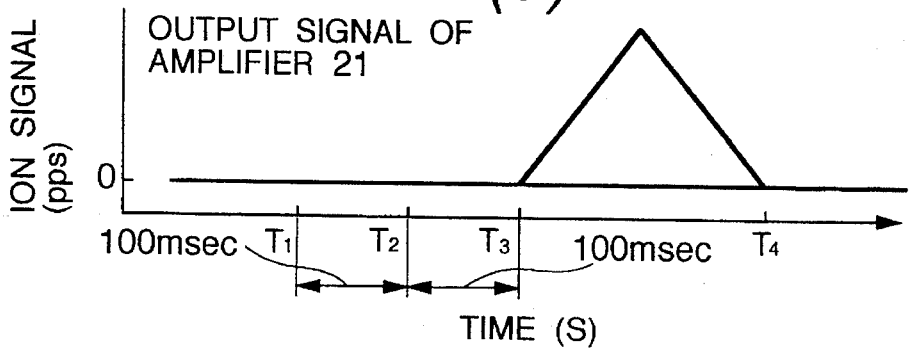

A third embodiment of the present invention will be described with reference to FIG. 5 and FIGS. 6A to 6D. In this embodiment, a shield plate 61 is provided between the mass separating portion 18 and the ion detector 20. The shield plate 61 has a function of keeping the close state until a time $T_3$ and keeping the open state after the time $T_3$, as shown in FIG. 6B.

The shield plate 61 can prevent ions and other matters from reaching the ion detector 20 before the state in which ions of the sample can be detected in the ion detecting portion 20. Thus, the ion detector 20 can be prevented from being deteriorated.

As described above, according to the present invention, it becomes possible to reduce background noise, and hence to improve detection accuracy in mass spectrometry.

Although the present invention has been described hereinabove with reference to the preferred embodiments thereof, it is to be understood that the invention is not limited to such embodiments alone, and a variety of other modifications and variation will be apparent to those skilled in the art without departing from the spirit of the invention.

The scope of the invention, therefore, is to be determined solely by the appended claims.

We claim:

1. In a plasma ion mass spectrometer comprising:

a plasma ion source for ionizing a sample with a plasma; and a mass spectrometric portion for performing mass spectrometry for said ionized sample;

the improvement comprising:

a shielding device for shielding the flow of said ionized sample from said plasma ion source after an elapse of a specified time; and a holding device for holding, ions of said sample accumulated before shielding the flow of said ionized sample, for a specified time after shielding the flow of said ionized sample;

thereby performing mass spectrometry for said ions of said sample held in said holding device.

2. In a plasma ion mass spectrometer comprising:

a plasma ion source for ionizing a sample with a plasma; and a mass spectrometric portion for performing mass spectrometry for said ionized sample;

the improvement comprising:

a restricting device for restricting the flow of said ionized sample from said plasma ion source in terms of time; and a filter for limiting a light component mixed with ions of said sample accumulated before restricting the flow of said ionized sample;

thereby performing mass spectrometry for said ions of said sample passed through said filter.

3. A plasma ion mass spectrometer according to claim 2, further comprising a retarding device for retarding a time required for supplying said ions of said sample from said plasma ion source to said mass spectrometric portion.

4. A plasma ion mass spectrometer according to claim 3, wherein said retarding device is a holding device for temporarily holding said ions of said sample.

5. A plasma ion mass spectrometer according to claim 4, wherein said retarding device is an ion trap.

6. A plasma ion mass spectrometer according to claim 4, wherein said holding device has a configuration capable of shielding the flow of said ionized sample from said plasma ion source.

7. A plasma ion mass spectrometer according to claim 6, wherein, said holding device, after shielding the flow of said ionized sample from said plasma ion source, holds said ions of said sample accumulated before shielding the flow of said ionized sample in such a manner as to reduce said light component.

8. A plasma ion mass spectrometer according to claim 6, wherein said holding device, after shielding the flow of said ionized sample from said plasma ion source, holds said ions of said sample accumulated before shielding the flow of said ionized sample in such a manner as to reduce a neutral particle component mixed with said ions of said ionized sample.

9. In a plasma ion mass spectrometer comprising:

a plasma ion source for ionizing a sample with a plasma; and a mass spectrometric portion for performing mass spectrometry for said ionized sample;

the improvement comprising:

a restricting device for restricting the flow of said ionized sample from said plasma ion source in terms of time; and a filter for limiting an electromagnetic radiation component mixed with ions of said sample accumulated before restricting the flow of said ionized sample;

thereby performing mass spectrometry for said ions of said sample passed through said filter.

10. In a plasma ion mass spectrometer comprising:

a plasma ion source for ionizing a sample with a plasma; and a mass spectrometric portion for performing mass spectrometry for said ionized sample;

the improvement comprising:

a restricting device for restricting the flow of said ionized sample from said plasma ion source in terms of time; and a filter for limiting a neutral particle component mixed with ions of said sample accumulated before restricting the flow of said ionized sample;

thereby performing mass spectrometry for said ions of said sample passed through said filter.

11. A plasma ion mass spectrometer comprising:

a plasma ion source for ionizing a sample with a plasma;

a restricting device for restricting the flow of said ionized sample from said plasma ion source in terms of time; and an ion type mass spectrometric portion including a filter for limiting a light component mixed with said ions of said sample accumulated before restricting the flow of said ionized sample, and performing mass spectrometry for said ions of said sample passed through said filter.

12. A plasma ion mass spectrometry comprising the steps of:

ionizing a sample for plasma;

restricting the flow of said ionized sample in terms of time;

limiting a light component mixed with ions of said sample accumulated before restricting the flow of said ionized sample in said terms of time; and performing mass spectrometry for said ions of said sample limited in said light component.

13. A plasma ion mass spectrometry comprising the steps of:

ionizing a sample with plasma;

restricting the flow of said ionized sample in terms of time;

limiting an electromagnetic radiation component mixed with ions of said sample accumulated before restricting the flow of said ionized sample in said terms of time; and performing mass spectrometry for said ions of said sample limited in said electromagnetic radiation component.

14. A plasma ion mass spectrometry comprising the steps of:

ionizing a sample with plasma;

restricting the flow of said ionized sample in terms of time; and performing mass spectrometry for ions of said sample accumulated before restricting the flow of said ionized sample in said terms of time, in an ion trap type mass spectrometric portion.

15. A plasma ion mass spectrometry comprising the steps of:

ionizing a sample with plasma;

restricting the flow of said ionized sample in terms of time;

limiting a neutral particle component mixed with ions of said sample accumulated before restricting the flow of said ionized sample in said terms of time; and performing mass spectrometry for said ions of said sample limited in said neutral particle component.

16. A plasma ion mass spectrometry comprising the steps of:

ionizing a sample with plasma;

shielding the flow of said ionized sample after an elapse of a specified time;

holding, for a specified time, ions of said sample accumulated before shielding the flow of said ionized sample; and performing mass spectrometry for said ions of said sample held for said specified time.

* * * * *